US007101028B2

(12) United States Patent
Takagi

(10) Patent No.: US 7,101,028 B2
(45) Date of Patent: Sep. 5, 2006

(54) INK CARTRIDGE FOR INK-JET RECORDING DEVICE

(75) Inventor: Osamu Takagi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 123 days.

(21) Appl. No.: 10/448,402

(22) Filed: May 30, 2003

(65) Prior Publication Data

US 2003/0222958 A1 Dec. 4, 2003

(30) Foreign Application Priority Data

Jun. 4, 2002 (JP) ..... 2002-162422

(51) Int. Cl.
*B41J 2/175* (2006.01)

(52) U.S. Cl. ..... 347/86

(58) Field of Classification Search ..... 347/7, 347/84–87; 220/495.01, 495.07
See application file for complete search history.

(56) References Cited

U.S. PATENT DOCUMENTS 5,216,452 A * 6/1993 Suzuki ..... 347/86
5,650,811 A 7/1997 Seccombe et al.
6,000,788 A 12/1999 Iida
6,193,364 B1 2/2001 Iida
6,315,402 B1 * 11/2001 Kawase ..... 347/85
6,471,343 B1 * 10/2002 Shimizu et al. ..... 347/85
6,536,885 B1 * 3/2003 Kuribayashi et al. ..... 347/85
6,663,220 B1 * 12/2003 Suzuki et al. ..... 347/36
2001/0006396 A1 7/2001 Iida

FOREIGN PATENT DOCUMENTS

| | | |
|---|---|---|
| JP | 58-108154 | 6/1983 |
| JP | A 7-68782 | 3/1995 |
| JP | A 8-174860 | 7/1996 |
| JP | A 11-105299 | 4/1999 |
| JP | A 2000-141687 | 5/2000 |
| JP | A 2001-63091 | 3/2001 |

OTHER PUBLICATIONS

Chinese Office Action (w/English–language translation).

* cited by examiner

*Primary Examiner*—Stephen D. Meier
*Assistant Examiner*—An H. Do
(74) *Attorney, Agent, or Firm*—Oliff & Berridge, PLC

(57) ABSTRACT

An ink cartridge for an ink-jet recording device that includes first and second ink bags adapted to hold ink therein, and an ink channel formed between the first and second ink bags for supplying the first ink bag with the ink from the second ink bag. The ink channel is capable of being opened and closed by a closing mechanism provided to the ink-jet recording device. For example, the ink channel is made of flexible material so that the closing mechanism can close the ink channel by pressing it with a pressing member provided to the closing mechanism. The ink cartridge further includes an ink flow enhancing mechanism that allows the ink to flow smoothly through the ink channel when the ink channel is not closed by the closing mechanism.

26 Claims, 9 Drawing Sheets

INK CARTRIDGE FOR INK-JET RECORDING DEVICE

BACKGROUND OF THE INVENTION

The present invention relates to an ink cartridge for an ink-jet recording device, and more particularly, to an ink cartridge having a plurality of ink bags therein.

Generally, an ink-jet recording device is arranged such that an appropriate negative pressure (a pressure lower than atmosphere pressure) is created within an ink-jet printhead in order to maintain an ink meniscus formed in the ink-jet printhead. For example, if ink is supplied to the printhead from an ink bag provided within an ink cartridge, the ink bag is placed lower than the printhead to create negative pressure within the printhead by means of hydraulic head difference. In such an arrangement, however, the liquid level within the ink bag comes lower as the ink is consumed, resulting in change of the hydraulic head difference. Therefore, the dimension of the ink bag in the vertical direction has been limited, not only from reasons arising from the design of the ink-jet recording device, but also to keep the change of the hydraulic head difference within a predetermine range.

Recently, long size printheads, which are provided with a plurality of ink ejecting orifices arranged in the width direction of the recording medium, are widely used in order to increase the recording rate. Long size printheads, however, require large capacity ink bags since they consume large quantities of ink.

Japanese Patent Application Provisional Publication HEI 11-105299 discloses an ink-jet printer that has a flexible sub-tank provided on an ink channel connecting a printhead and a large capacity ink cartridge. A negative pressure is imparted to the printhead by means of hydraulic head difference between the sub-tank and the printhead. The printer provided with the sub-tank can keep the change of the hydraulic head difference caused by the consumption of the ink within a predetermined range while being capable of supplying sufficient amount of ink to the long size printhead from the large capacity ink cartridge.

However, the introduction of the sub-tank into the ink-jet printer requires a complicated ink channel structure and also increases the number of channel joints. Such ink channels may hardly allow bubbles to be discharged therefrom and/or have low ability of sealing gas and water vapor. Further, the flexible sub-tank should be frequently exchanged due to the low durability thereof.

In order to resolve the above-mentioned problem, it is suggested to replace the ink cartridge and the sub-tank with upper and lower ink bags directly connected to each other so that the complex ink channel connecting the ink cartridge and the sub-tank can be eliminated.

In the above case, the upper ink bag and lower ink bag serve as the ink cartridge and the sub-tank, respectively, and the ink flows from the upper ink bag into the lower ink bag due to its own weight. Thus, the consumed ink can be supplied into the lower ink bag (sub-tank bag) from the upper ink bag (the ink cartridge bag) without significant delay as long as the ink cartridge bag contains a large amount of ink. However, time required for supplying ink into the sub-tank bag increases as the amount of ink remaining in the ink cartridge bag decreases. This is because the weight of the ink within the ink cartridge bag decreases and also since the pressure within the ink cartridge bag becomes negative (lower than the atmosphere pressure). Although the printhead has the ability of high speed printing, the increase of the time required for replenishing the sub-tank bag with ink results in increase of the total printing time since the ink-jet recording device have to stop printing during the ink replenishment of the sub-tank bag. In addition, because of the negative pressure in the ink cartridge bag, not all of the ink therein can be consumed, but a small amount will be left.

Therefore, there is a need for an ink cartridge for an ink-jet recording device that is capable of implying negative pressure to the printhead without requiring a sub-tank to be provided within the ink-jet recording device, while being also capable of smoothly supplying a large amount of ink to the printhead irrespective of the ink amount remaining in the ink cartridge.

SUMMARY OF THE INVENTION

The present invention is advantageous in that an ink cartridge for an ink-jet recording device is provided that satisfies the above mentioned needs.

According to an aspect of the invention, there is provided an ink cartridge for an ink-jet recording device that includes first and second ink bags adapted to hold ink therein, and an ink channel formed between the first and second ink bags for supplying the first ink bag with the ink from the second ink bag. The ink channel is capable of being opened and closed by a closing mechanism provided to the ink-jet recording device. For example, the ink channel is made of flexible material so that the closing mechanism can close the ink channel by pressing it with a pressing member provided to the closing mechanism.

The ink cartridge further includes an ink flow enhancing mechanism that allows the ink to flow smoothly through the ink channel when the ink channel is not closed by the closing mechanism.

Optionally, the second ink bag has a larger volumetric capacity than the first ink bag and has an inner wall formed to decline toward an inlet of the ink channel. Optionally, the first ink bag has a horizontal dimension longer than a vertical dimension thereof. Optionally, the first and second ink bags and the ink channel are formed in a single-piece. Optionally, the first and second ink bags and the ink channel are fixed, by welding, to an inner wall of a cartridge case of the ink cartridge.

In an exemplary embodiment of the invention, the ink flow enhancing mechanism includes a recess formed to a cartridge case within which the first and second ink bags and the ink channel are placed. The recess is formed such that the pressing member fits therein. In this case, the pressing member closes the ink channel by presses it against the recess.

In the above case, the ink channel is made of first and second sheets fixed to each other along side edges thereof, and placed within the cartridge case with the first sheet facing said recess. The first sheet is arranged such that a portion of the first sheet extending over the recess has a longer width than the recess.

In particular cases, the first sheet is arranged to have a length between side edges of the ink channel that is 1% through 30% longer than a distance between the side edges of the ink channel.

Alternatively or additionally, the first sheet is arranged to have a length between the side edges of the ink channel that is 1% through 30% longer than a length of the second sheet between the side edges of the ink channel.

Optionally, at least one of the pressing members and an inner wall of the recess are made of elastic material.

Optionally, a side of the ink channel opposing the recess is at least partially fixed to an inner wall of the recess.

In another exemplary embodiment of the invention, the ink flow enhancing mechanism includes an elastic member disposed in the ink channel at a portion to be pressed by the pressing member, which elastic member biases the ink channel back to an open state thereof when the pressing member stops pressing the ink channel.

Optionally, the elastic member has a hollow shape, such as a hollow cylinder, so that the ink can flow therethrough.

In yet another exemplary embodiment of the invention, the pressing member presses a predetermined area of an outer surface of the ink channel. The ink flow enhancing mechanism includes an elastic member attached to at least a part of the predetermined area of the ink channel, which elastic member biases the ink channel back to an open state thereof when the pressing member stops pressing the ink channel.

According to another aspect of the invention, there is provided an ink cartridge for an ink-jet printer which includes first and second ink containers, and an ink channel connecting said first and second ink containers The second ink container is disposed below a printhead of the ink-jet printer and connected to the printhead for supplying ink when the ink cartridge is installed in the ink-jet printer. Since the second ink container is disposed below the printhead, negative pressure will be caused in the printhead when the second ink container is connected to the printhead, irrespective of the location of the first ink container.

An ink channel is provided that connects the first and second ink containers so as to allow ink held in the first ink container being supplied into said second ink container. Thus, the ink cartridge as a whole is capable of supplying a large amount of ink to the printhead. The ink channel is formed of elastic first and second sheets fixed to each other along side edges thereof. The second sheet has elasticity and is biased to be spaced apart from the first sheet. Thus, the ink channel can be closed by pressing the second sheet toward the first sheet, and the ink channel opens by itself and allows ink flowing smoothly therethrough when it is stopped pressing the second sheet since the second sheet is biased to move apart from the first sheet.

In an exemplary embodiment, the biasing force is generated by forming the second sheet so as to have a shorter width than the first sheet.

In the above case, the ink cartridge may further include a wall provided with a recess. The ink channel may be disposed in front of the wall with the first sheet facing the recess. The first sheet may have a bent shape that protrudes into said recess. Optionally, the first sheet is at least partially fixed to the recess. Optionally, the second sheet has a substantially flat shape. Alternatively, the second sheet may have a bent shape protruding in a direction opposite to the recess.

Optionally, a space defined within the ink channel has substantially the same width as the recess. Alternatively, the space may have a shorter width compared to the recess.

Optionally, an inner wall of the recess is made of elastic material.

In another exemplary embodiment of the invention, an elastic member is disposed between the first and second sheets, which elastic member biases the second sheet to be spaced apart from the first sheet.

The elastic member may have a hollow cylindrical shape so as to allow the ink flowing therethrough.

In yet another exemplary embodiment of the invention, an elastic member, which may be a thin sheet, is bonded on an outer surface of at least one of the first and second sheets and the elastic member biases the second sheet to be spaced apart from the first sheet.

BRIEF DESCRIPTION OF THE ACCOMPANYING DRAWINGS

FIG. 1 schematically shows an ink cartridge and an ink-jet printhead H of a not shown ink-jet recording device according to a first embodiment of the invention;

FIGS. 2A and 2B illustrate an opening/closing process of an upper flow channel of the ink cartridge shown in FIG. 1;

FIGS. 3A, 3B and 3C schematically illustrate an opening/closing operation of an ink channel arranged within an cartridge case having no recess;

DETAILED DESCRIPTION OF THE EMBODIMENTS

Figure 1:
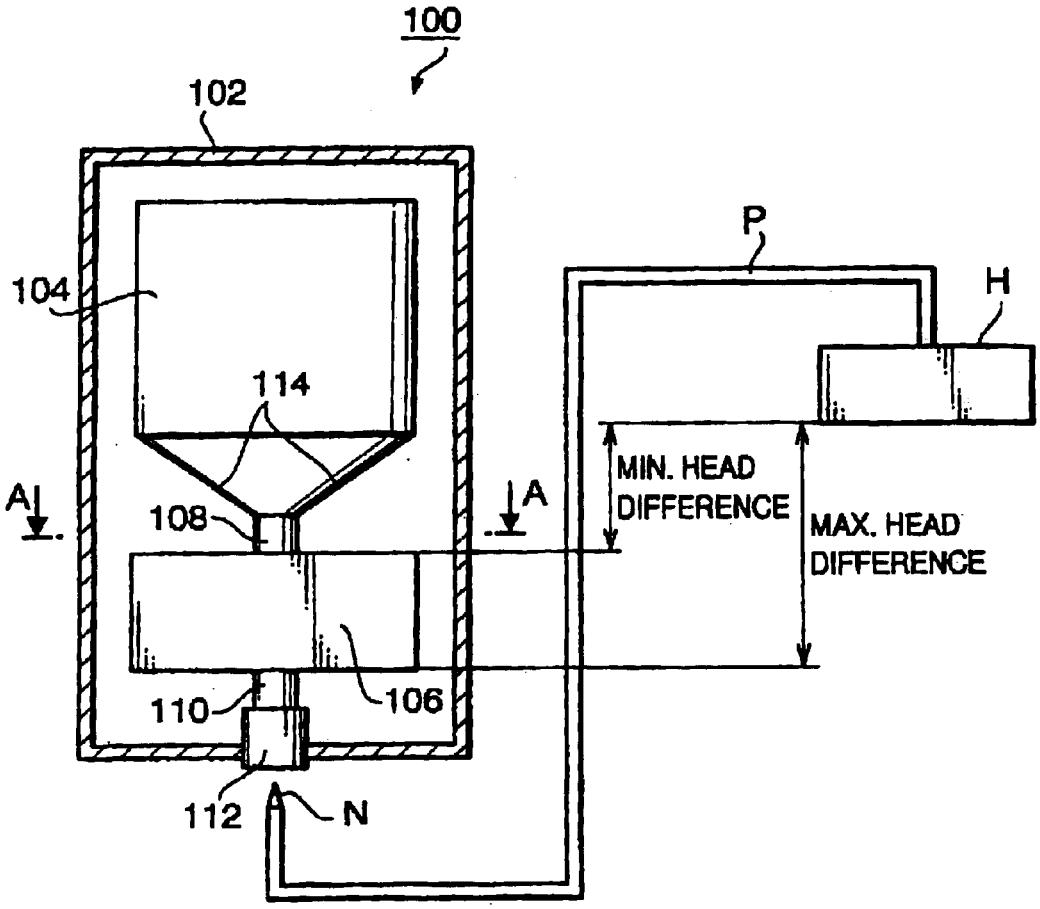

Hereinafter, embodiments of the present invention will be described with reference to the accompanying drawings in which like parts are identified with like reference numerals.

The inventor of the present invention has intensively investigated an ink cartridge for an ink-jet recording device, and in particular, an ink cartridge having a large capacity but being capable of creating a stable negative pressure within an ink-jet printhead without requiring a sub-tank being provided to the ink-jet recording device. The inventor has found that such an ink cartridge can be obtained by providing at least two ink bags into the ink cartridge, connecting one of the ink bags with the printhead to supply ink thereinto and placing this ink bag lower than the printhead, forming the other ink bags as large as possible, providing at least one ink channel connecting these large ink bags with the ink bag supplying ink to the printhead, and closing the at least one ink channel during the time the ink is supplied to the printhead.

The inventor has further found, experimentally, that ink does not smoothly flow through the ink channel if the amount of ink remaining in the other ink bags is small. Therefore, the inventor has further provided an ink flow enhancing mechanism to the ink cartridge so that the ink can be smoothly supplied to the ink bag connected to the printhead from the other ink bags even if the amount of ink remaining in the other ink bags is small.

Therefore, a significant feature of the ink cartridge according to the embodiments of the invention, which will be describe hereinafter, resides in that the ink cartridge includes at least two ink bags and an ink flow enhancing mechanism provided on an ink channel formed between the ink bags.

FIG. 1 schematically shows an ink cartridge 100 and an ink-jet printhead H of a not shown ink-jet recording device according to a first embodiment of the invention.

The ink cartridge 100 shown in FIG. 1 has a cartridge case 102 and upper and lower ink bags 104 and 106 placed within the cartridge case 102 and arranged in vertical direction. The upper and lower ink bags 104 and 106 are connected with an upper ink channel 108, while a lower ink channel 110 connects the lower ink bag 106 with a spout 112, which is provided to the bottom of the cartridge case 102.

When the ink cartridge 100 is installed into the ink-jet recording device (not shown), a needle-shaped tip end N of a pipe P, which is connected with the printhead H, pierces into the spout 112 so that the ink can be supplied from the ink cartridge 100 to the printhead H through the pipe P. The upper ink channel 108 is closed by pressing a pressing member 120 (see FIGS. 2A and 2B), which is provided to the ink-jet recording device (not shown), against the upper ink channel 108 in a direction perpendicular to a flow direction of the ink (a direction perpendicular to the paper on which FIG. 1 is drawn).

Preferably, the upper and lower ink bags 104 and 106 are formed of flexible material such as gas-proof and/or vapor-tight laminated film. It should be noted, however, that the material of the upper and lower ink bags 104 and 106 is not limited to those mentioned above.

Preferably, the upper and lower ink bags 104, 106 and the upper and lower ink channels 108, 110 are integrally formed by welding a pair of film sheets so as to enhance the productivity of the ink cartridge 100, and also to prevent leakage of ink, gas, vapor, or the like within the ink cartridge 100. Further, the rim of the pair of film sheets may be welded to the cartridge case 102 to integrate the upper and lower ink bags 104, 106, as well as the upper and lower ink channels 108, 110, with the cartridge case 102.

As shown in FIG. 1, the lower ink bag 106 is located vertically below the upper ink bag 104 so that the ink contained in the upper ink bag 104 flows down to the lower ink bag 106 through the upper ink channel 108 by gravitation. The amount of ink supplied into the lower ink bag 106 is controlled by opening/closing the upper ink channel 108. The opening/closing of the upper ink channel 108 is achieved by a pressing member 120 (see FIGS. 2A and 2B) that is provided to the ink-jet recording device (not shown). The pressing member 120 will be described later.

The amount of ink fed into the lower ink bag 106 is controlled such that the lower ink bag 106 will not be fully filled with ink. In the present embodiment, it is controlled such that the lower ink bag 106 is filled not more than approximately 80% of the volumetric capacity thereof. This is to prevent ink pressure increase within the lower ink bag 106 due to oversupply of ink from the upper ink bag 104, since such pressure increase may inhibit creation of negative pressure in the printhead H, which negative pressure is necessary for forming the ink meniscus.

If the lower ink bag 106 is not fully filled with ink, the hydraulic head difference of the inks in the lower ink bag 106 and printhead H determines the pressure within the printhead H. Since the lower ink bag 106 is placed lower than the printhead H, the hydraulic head difference always creates a negative pressure within the printhead H.

The hydraulic head difference changes between minimum and maximum values which are determined substantially by the vertical distance between ink ejecting orifices (not shown) of the printhead H and the upper and lower surfaces of the lower ink bag 106, respectively. The lower ink bag 106 is designed so as to have a small dimension in vertical direction in order to keep the change of the hydraulic head difference as small as possible, and have a large horizontal dimension to create a large volumetric capacity for holding ink.

It should be noted that the lower ink bag 106 arranged as above allows the upper ink bag 104 to be designed in a desired shape and volumetric capacity since the lower ink bag 106 serves to create negative pressure within the printhead H irrespective of the form and size of the upper ink bag 104. Thus, a large bag can be utilized as the upper ink bag 104 to hold a large amount of ink.

If the amount of ink within the lower ink bag 106 becomes small, ink is supplied from the upper ink bag 104 into the lower ink bag 106. The detail of supplying ink into the lower ink bag 106 will be described later. Preferably, a slanted portion 114 is formed at the bottom of the upper ink bag 104, which slanted portion 114 declines toward an inlet the upper ink channel 108 so as to allow the ink smoothly flowing into the lower ink bag 106 event if only a small amount of ink remains in the upper ink bag 104. Further, as previously mentioned, the ink flow enhancing mechanism is provided to the ink cartridge 100 in order to achieve smooth supply of ink to the lower ink bag 106. The ink flow enhancing mechanism will be described hereinafter.

Figure 2A:
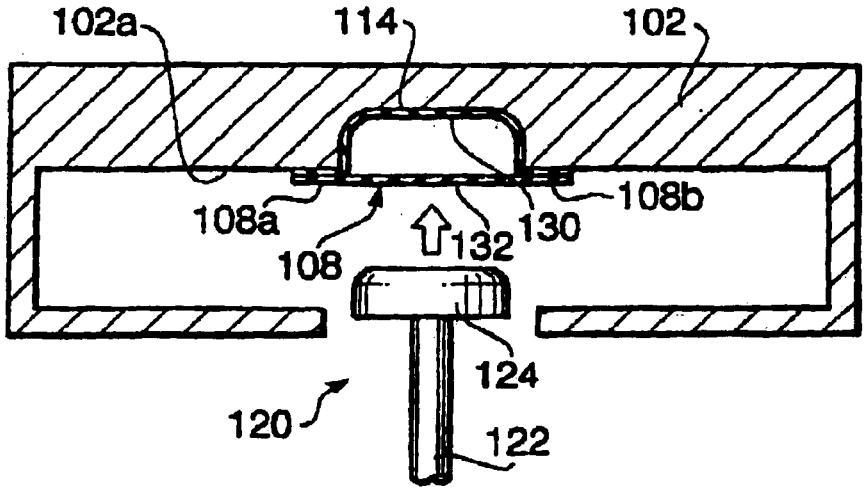
Figure 2B:
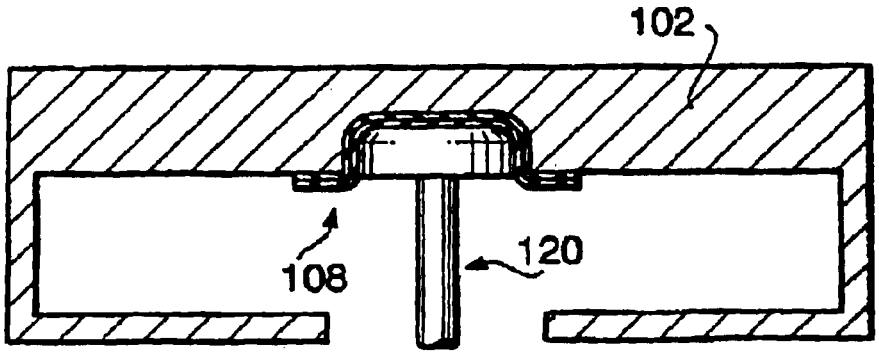

FIGS. 2A and 2B illustrate an opening/closing process of the upper flow channel 108 of the ink cartridge shown in FIG. 1. In FIGS. 2A and 2B are shown cross sections of the cartridge case 102 and the upper ink channel 108 that are taken along a line A—A in FIG. 1. Further, the pressing member 120 is also shown in FIGS. 2A and 2B, which pressing member 120 is a part of the ink-jet recording device (not shown).

As shown in FIGS. 2A and 2B, a recess 116 is formed at an inner surface of the cartridge case 102. The upper ink channel 108 is formed of first and second sheets 130 and 132 having flexibility and elasticity. First and Second sheets 130 and 132 are fixed to each other in a waterproof manner along respective side edges 108*a* and 108*b* thereof by welding or with adhesive. The upper ink channel 108 is arranged within the cartridge case 102 so as to cover the recess 116 with the first sheet 130 facing recess 116. The side edges 108*a*, 108*b* of the upper ink channel 108 are fixed on the inner wall 102*a* of the cartridge case 102 at respective sides of the recess 116. The widths, or sizes in horizontal direction, of the first and second sheets 130 and 132 are such that the second sheet 132 extends substantially flat in front of the recess 116 while the first sheet 130 bends into the recess 116 and extends along the inner wall thereof. Preferably, the second sheet 132 is slightly expanded in the horizontal direction.

The pressing member 120 includes a supporting rod 122 and a pressing head 124 attached to the tip end of the supporting rod 122. The pressing head 124 is formed so as to fit right in the recess 116. The pressing member 120 is actuated by a mechanism (not shown) of the ink-jet recording device (not shown) so that the pressing head 124 is pressed into and pulled out of the recess 116.

When the upper ink channel 108 is to be closed to stop the ink flowing therethrough, the pressing member 120 is moved toward the recess 116 so as to fit the pressing head 124 thereinto as shown in FIG. 2B. As a result, the upper ink channel 108 is pressed between the pressing member 120 and the recess 116 and the ink stops flowing through the upper ink channel 108.

On the contrary, the pressing member 120 is pulled out of the recess 116, as shown in FIG. 2A, when it is required to open the upper ink channel 108. When the pressing member 120 is retracted, or the pressing head 124 is pulled out from the recess 116, the second sheet 132 returns to its initial flat state due to the elasticity thereof, and thereby opens the upper ink channel 108 so that the ink can flow therethrough.

Preferably, at least one of the pressing head 124 and the inner wall of the recess 116 is made of elastic material. Suitable elastic materials include rubber sheet and foam material such as urethane foam. Such an arrangement allows the pressing head 124 and the recess 116 to press the upper ink channel 108 with an uniform pressure over the width of the upper ink channel 108 and thereby ensures closing of the upper ink channel 108 when the pressing head 124 is fitted into the recess 116.

It should be noted that the recess 116 formed to the cartridge case 102 serves an important function in making smooth ink flow through the upper ink channel 108 as will be described hereinafter.

Figure 3A:
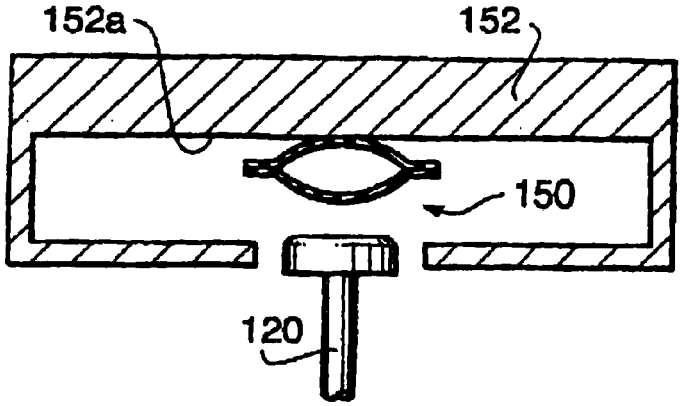
Figure 3B:
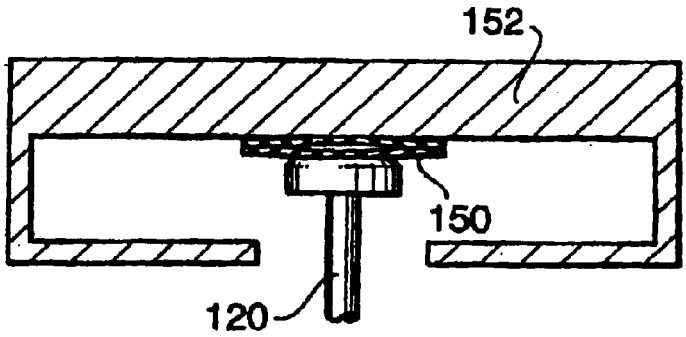
Figure 3C:
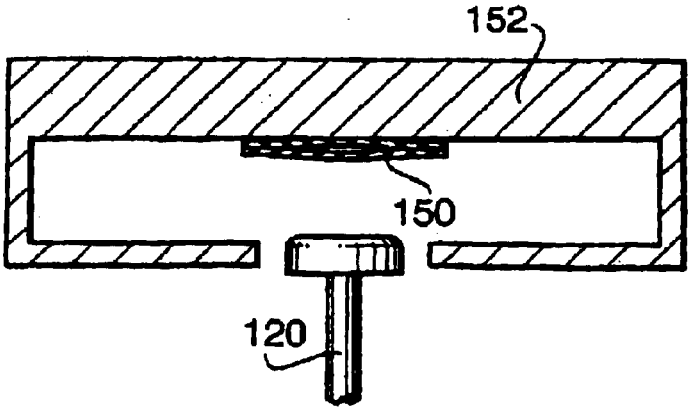

FIGS. 3A, 3B and 3C schematically illustrate an opening/closing operation of an ink channel 150 arranged within a cartridge case 152 having no recess. As shown in FIGS. 3A through 3C, the ink channel 150 is closed by being pressed between the inner wall 152*a* of the cartridge case 152 and the pressing member 120. Since the inner wall 152*a* has no recess, the ink channel 150 will be appressed to the flat inner wall 152*a* as shown in FIG. 3B when pressed by the pressing member 120. In this case, the ink channel hardly recovers to the initial shape (FIG. 3A) by itself even after the pressing member 120 is retracted (see FIG. 3C).

Even in the above case, the ink channel 150 may be opened by the weight of the ink contained in an upper ink bag (not shown) connected to the ink channel 150, resulting in a smooth ink flow through the ink channel 150. However, as the amount of ink in the upper ink bag decreases, the time until the ink channel 150 begins to open due to the ink weight (and hence the time required for fully open the ink channel 150) increases. This time increases with the consumption of the ink in the upper ink bag, and finally the ink cannot open the ink channel 150 with the weight thereof since the amount, or weight, of ink remaining in the upper ink bag is too small. As a result, the ink channel 150 remains closed.

As above, in the case the cartridge case 152 is not provided with the recess 116 as shown in FIGS. 2A and 2B, the ink can be supplied from the upper ink bag 104 to the lower ink bag 106 through the upper ink channel 108 smoothly and in a short time only when a large amount of ink remains in the upper ink bag 104. The time required to replenish the lower ink bag 106 with sufficient ink increases as the amount of ink remaining in the upper ink bag 104 decreases, resulting in increase of total printing time.

On the contrary, if the recess 116 is formed to the inner wall 102*a* of the cartridge case 102, the second sheet 132 is stretched into the recess 116 and appressed to the second sheet 130 (see FIG. 2B) as the pressing member presses the upper ink channel 108. The stretched second sheet 132 generates an elastic restoring force that biases the second sheet back to the initial flat state, or biases the second sheet away from the first sheet 130. Thus, if the pressing member 120 is retracted, the second sheet 132 returns from the stretched state to the initial state shown in FIG. 2A and thereby opens the upper ink channel 108. Accordingly, the upper ink channel 108 opens by itself even if the amount of ink remaining in the upper ink bag 104 is small and allows the ink smoothly flowing down from the upper ink bag 104 into the lower ink bag 106.

Figure 4A:
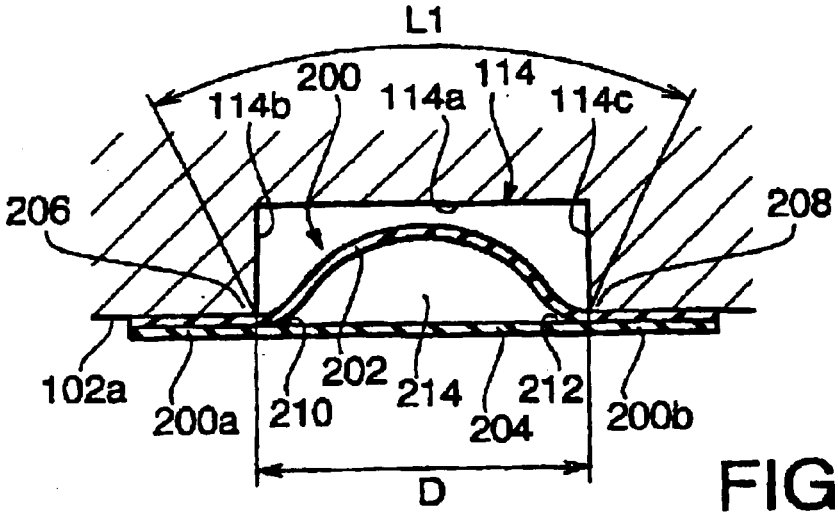
FIGS. 4A, 4B and 4C show sectional views of modifications of the upper ink channel 108 according to the first embodiment of the invention.
Figure 4B:
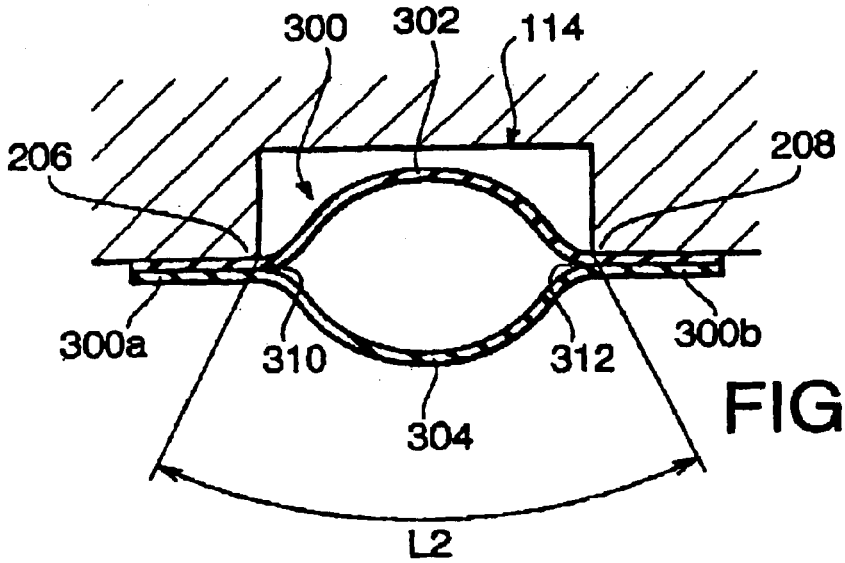
Figure 4C:
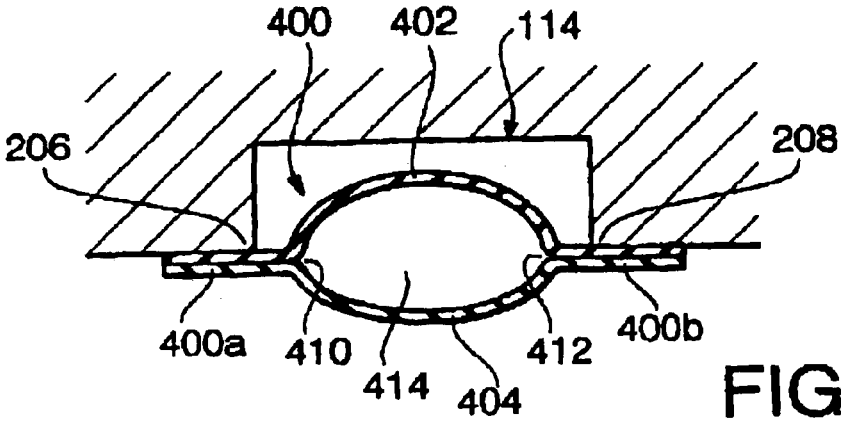

FIGS. 4A, 4B and 4C show sectional views of modifications of the upper ink channel 108 according to the first embodiment of the invention, which are arranged to ensure smooth ink flow therethrough even if the amount of ink remaining in the upper ink bag 104 is small. Note that the sectional views shown in FIGS. 4A through 4C are taken along the same plane along which the sectional view of FIG. 2A is taken.

FIG. 4A shows an upper ink channel 200 formed of first and second sheets 202 and 204, which have flexibility and elasticity and are fixed to each other along respective side edges thereof. The first and second sheets 202 and 204 may be fixed to each other by any suitable methods including the use of adhesive. In the present embodiment, the first and second sheets 202, 204 are fixed to each other by welding since it allows the upper ink channel 200 to be produced by only heating predetermined portions of the first and second sheets 202, 204.

The recess 116 has a bottom wall 114*a*, and a pair of side walls 114*b* and 114*c*. First and second corners 206 and 208 are defined between the inner wall 102*a* and the side walls 114*b* and 114*c* of the recess 116, respectively.

A mid portion of the first sheet 202 extending between the first and second corners 206, 208 has a length (width) L1 longer than the distance between the first and second corners 206, 208, or the width D of the recess 116. Thus, the first sheet 202 has a bent shape protruding into the recess 116.

A mid portion of the second sheet 204 extending between the first and second corners 206, 208 has length (width) L2 that is equal to the width D of the recess 116. Thus, the second sheet 204 is essentially flat and is normally spaced apart from the first sheet 202 being in the bent shape.

It should be noted that the length L1 of the mid portion of the first sheet 202 is preferably 1% through 30% longer than the width D of the recess 116. This is because the upper ink channel 200 may not open sufficiently if the length difference is less than 1%, and because, if the length difference exceeds 30%, wrinkles may be formed on the first sheet 202 when the upper ink channel 200 is pressed by the pressing member 120, which wrinkles inhibit the upper ink channel 200 to be completely closed and may also cause cracks in the upper ink channel 200.

Figure 5:
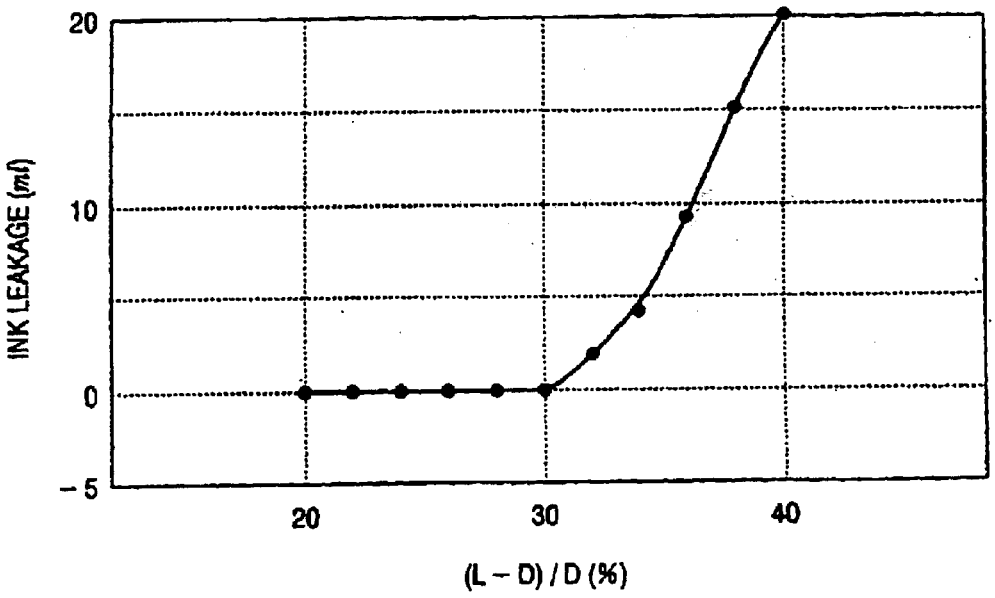
FIG. 5 shows experimental data on a relation between a length L1 of a mid portion of a first sheet of the upper ink channel shown in FIG. 4A and an amount of ink leakage through the upper ink channel.

FIG. 5 shows experimental data on a relation between the length L1 of the mid portion of the first sheet 202 and the amount of ink leakage through the upper ink channel 203. The horizontal axis in FIG. 5 indicates the ratio of the length difference L1-D to the width D, and the vertical axis indicates the amount of ink leakage through the upper ink channel.

The experiment was conducted by using the ink cartridge 100 provided with the upper ink channel 200 shown in FIG. 4A and changing the length L1 of the mid portion of the first sheet 202. The upper ink channel 200 was closed and 500 ml of ink was introduced into the upper ink bag 104. After a week, the amount of ink that had flowed down into the lower ink bag 106 through the upper ink channel 200 was measured. The recess 116 formed to the inner wall 102*a* of the cartridge case 102 had a rectangular section of which depth and width were 3 mm and 20 mm, respectively.

As shown in FIG. 5, the amount of ink leakage through the upper ink channel 200 drastically increases if the first sheet 202 comes longer than the width D of the recess 116 for more than 30%. This is because wrinkles, which make the upper ink channel 200 leaky, are formed on the first sheet 202 pressed between the pressing member 120 and the recess 116. According to the experiments carried out by the inventor, the preferable length of the first sheet is within the range from 3% to 7% longer than the width D of the recess 116.

FIG. 4B shows an upper ink channel 300 formed of first and second sheets 302 and 304, which have flexibility and elasticity and are fixed to each other along respective side edges thereof. The side edges of the upper ink channel 300 are fixed to the inner wall 102*a* of the cartridge case 102 so that the upper ink channel 300 covers the recess 116 with the first sheet 302 facing the recess 116.

The upper ink channel 300 shown in FIG. 4B differs from the upper ink channel 200 shown in FIG. 4A in that the mid portion of the second sheet S302 extending between the first and second corners 206 and 208 has a length L2 longer than the width D of the recess 116 (L2>D). Except the above, the arrangement of the upper ink channel 300 shown in FIG. 4B is essentially the same as the upper ink channel 200 shown in FIG. 4A.

Preferably, the length L2 of the mid portion the second sheet S302 differs from the length L1 of the mid portion the first sheet S301. More preferably, the second sheet S302 is arranged such that the length L1 of the mid portion the first sheet S301 is 1% through 30% longer than the length L2 of the mid portion of the second sheet S302, so that the upper ink channel reliably opens when the pressing member 120 is retracted to stop pressing the upper ink channel 303.

As already described, the upper ink channel 203 shown in FIG. 4A has side edges 200*a* and 200*b* at which the first and second sheets 202, 204 are fixed to each other. As shown in FIG. 4A, the side edges 200*a* and 200*b* have innermost portions 210 and 212, respectively. The innermost portions 210 and 212 are fixed on the inner wall 102*a* of the cartridge case 102 at first and second corners 206 and 208, respectively. Thus, a passage 214 defined between the first and second sheets 202 and 204 has substantially the same width as the recess 116.

Similarly, the upper ink channel 300 shown in FIG. 4B also has side edges 300*a* and 300*b*, and innermost portions 310 and 312 thereof are fixed on the inner wall 102*a* of the cartridge case 102 at the first and second corners 206 and 208, respectively.

The upper ink channel 400 shown in FIG. 4C is a modification of the upper ink channel 300 shown in FIG. 4B. The upper ink channel 400 shown in FIG. 4C is also formed of first and second sheets 402 and 404, which have flexibility and elasticity and are fixed to each other along respective side edges thereof. Side edges 400*a* and 400*b* of the upper ink channel 402 are fixed on the inner wall 102*a* of the cartridge case 102 so that the upper ink channel 403 covers the recess 116 with the first sheet 402 facing the recess 116.

The side edges 400*a* and 400*b* of the upper ink channel 400, however, are fixed on the inner wall 102*a* of the cartridge case 102 such that the side edges 400*a* and 400*b* protrude above the recess 116 and the distance between the innermost edges thereof (410, 412) is shorter than the distance between the first and second corners 206 and 208 (the width D of the recess 116). Thus, the width of a passage 414 defined between the first and second sheets 402 is also shorter than the width D of the recess 116.

The first sheet 402 is arranged such that the length of the mid portion of the first sheet 402 extending between the first and second corners 206 and 208 is longer than the width D of the recess 116, and also such that the length of the portion of the first sheet 402 extending between the innermost edges 410, 412 is longer than the distance between the innermost edges 410, 412. Further, the upper ink channel 400 is arranged such that a portion of the first sheet 402 facing the recess 116 is longer than a portion of the second sheet 404 facing the recess 116.

The upper ink channel 400 arranged as above opens when the pressing member 120 is retracted to stop pressing the upper ink channel 400, even if the first and second sheets 402 and 404 are stuck to each other, at least by means of the restoring force of the second sheet 404 that is generated by the length difference and the elasticity of the first and second sheets 402 and 404. Therefore, ink can be rapidly supplied to the lower ink bag 106 even if only a small amount of ink remains in the upper ink bag 104.

It should be noted that, also in the upper ink channel 400 shown in FIG. 4C, the portion of the first sheet 402 facing the recess 116 is preferably 1% through 30% longer than the portion of the second sheet 404 facing the recess.

Further, in each of the upper ink channels 200, 300 and 400 shown in FIGS. 4A, 4B and 4C, respectively, it is recommended to fix at least a part of the first sheet (202, 302, 402) to the inner wall of the recess 116 to ensure that the upper ink channel (200, 300, 400) opens when the pressing member 120 stops pressing the upper ink channel (200, 300, 400).

Figure 6A:
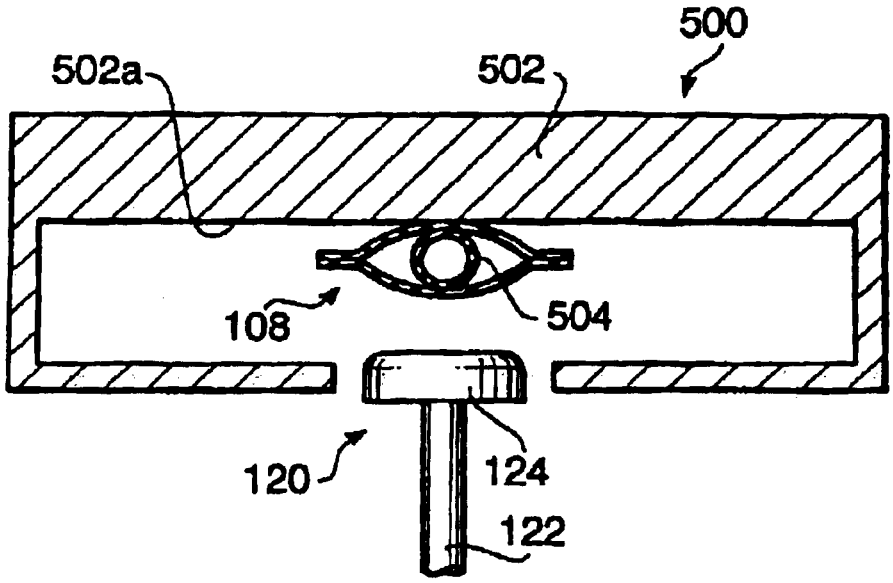
FIGS. 6A and 6B show a sectional view of an ink cartridge according to a second embodiment of the invention.
Figure 6B:
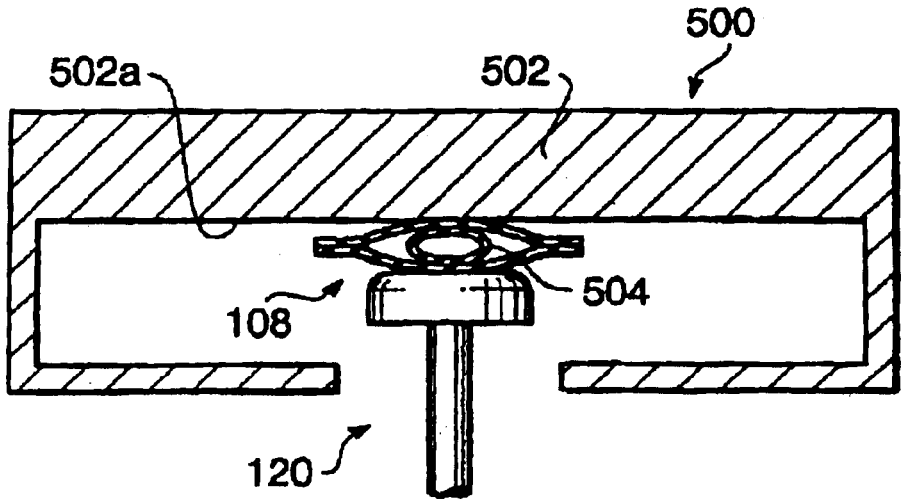

FIGS. 6A and 6B show a sectional view of an ink cartridge 500 according to a second embodiment of the invention. The ink cartridge 500 according to the second embodiment has substantially the same configuration as the ink cartridge 100 according to the first embodiment, except that it is provided with another type of ink flow enhancing mechanism and that the ink cartridge 502 is not provided with any recess and thus the inner wall 502*a* thereof is flat. Note that the sections shown in FIGS. 6A and 6B are taken along a plane within which the pressing member 120 presses the upper ink channel 108.

In the ink cartridge 500 shown in FIGS. 6A and 6B, a cylindrical elastic member (first elastic member) 504, which serves as the ink flow enhancing mechanism, is provided in the upper ink channel 108 at a location to be pressed by the pressing member 120. Therefore, if the pressing member 120 stops pressing the upper ink channel 108, the upper ink channel 108 opens by means of the elasticity of the elastic member 504 and allows ink to flow therethrough.

The material of the elastic member 504 is not limited to any particular material. The elastic member 504 may be made of any elastic materials, including natural rubber, artificial rubber, and elastomeric material. The shape of the elastic member 504 is also not limited to any particular shape. However, it is preferable that the elastic member 504 has a hollow shape so that a wide space is defined inside the upper ink channel through which ink can flow.

In order to reliably close the upper ink channel 108 with the pressing member 120, the surface of the pressing head 124 of the pressing member 120 and/or a portion of the inner wall 502*a* of the cartridge case 502, which is to be pressed by the pressing member 120 through the upper ink channel 108, may be made of elastic member. The elastic member 504 may of any kind of elastic material and is not limited to any particular material. Exemplary materials of the elastic member include rubber and foam material such as urethane foam.

If a part of the pressing member 120 or the inner wall 502*a* of the cartridge case 502 is formed by the elastic member mentioned above, the inner wall 502*a* of the cartridge case 502, the upper ink channel 108, the cylindrical elastic member 504 and the pressing head 124 come into contact with each other with no space therebetween as the pressing member 120 presses the upper ink channel 108 and hence the cylindrical elastic member 504. As a result, the upper ink channel 108 closes reliably.

It should be noted that a recess may be formed to the inner wall 502*a* of the cartridge case 502 at a location against which the pressing member 120 is pressed with the upper ink channel 108 therebetween, so that the upper ink channel 108 can be closed more reliably. Preferably, the recess is formed such that the pressing head 124 can fit right therein. Further preferably, the surface of the pressing head 124 is made of elastic material.

Figure 7A:
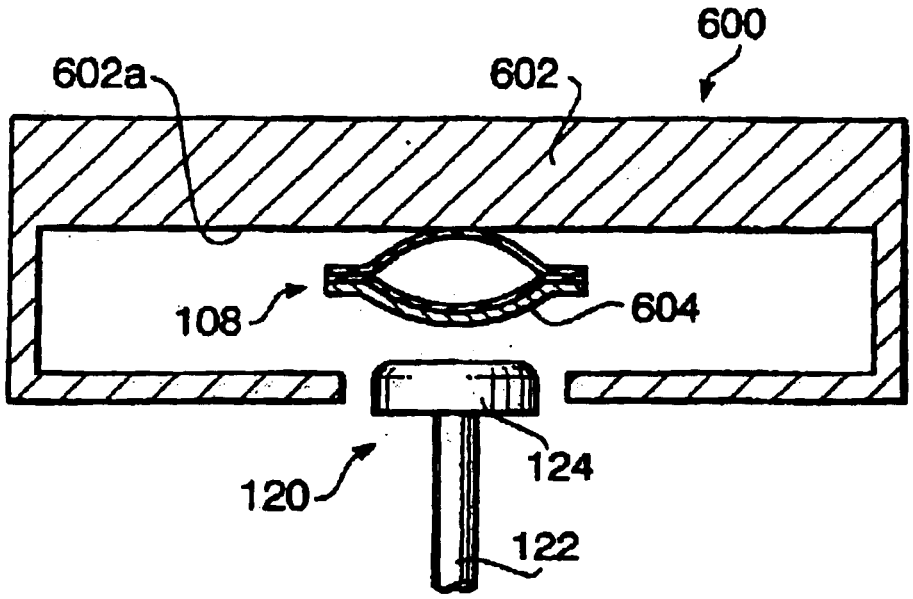
FIGS. 7A and 7B show a sectional view of an ink cartridge according to a third embodiment of the invention.
Figure 7B:
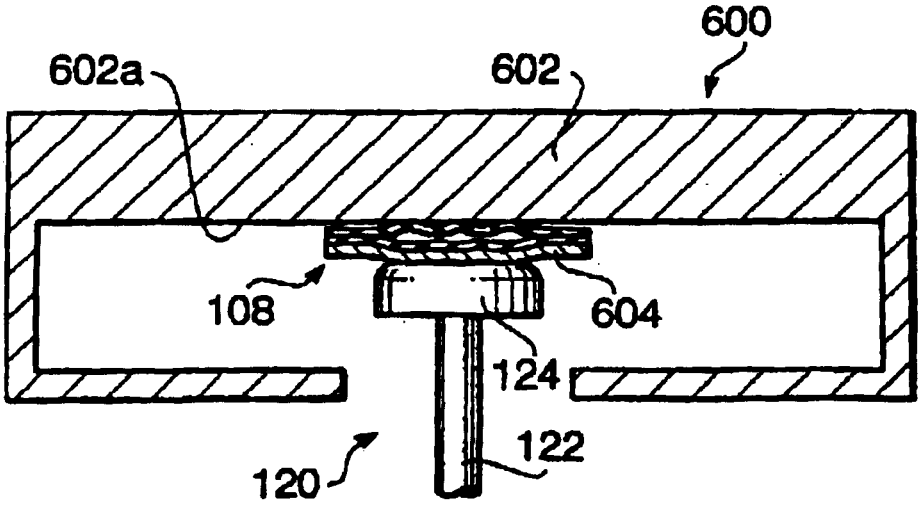

FIGS. 7A and 7B show a sectional view of an ink cartridge 600 according to a third embodiment of the invention. The ink cartridge 600 according to the third embodiment has substantially the same configuration as the ink cartridge 100 according to the first embodiment, except that it is provided with yet another type of ink flow enhancing mechanism and that the ink cartridge 602 is not provided with any recess and thus the inner wall 602*a* thereof is flat. Note that, the sections shown in FIGS. 6A and 6B are taken along a plane within which the pressing member 120 presses the upper ink channel 108.

In the ink cartridge 600 shown in FIGS. 7A and 7B, a thin plate like elastic member (second elastic member) 604 is attached to the outer surface of the upper ink channel 108 at a portion against which the pressing member 120 is to be pressed. The elasticity of the elastic member 604 restores the upper ink channel 108 to the opened state when the pressing member 120 stops pressing the upper ink channel 108. In the ink cartridge 600 shown in FIGS. 7A and 7B, the elastic member is attached to the upper ink channel at a side facing the pressing member 120. It should be noted, however, the elastic member 604 may be attached also to the side facing the inner wall of the cartridge case 102. Further, the elastic member 604 may also be attached on both sides of the upper ink channel 108 or around the outer circumference of the upper ink channel 108.

Preferably, the elastic member 604 is formed in a thin piece since it is attached to the outer surface of the upper ink channel 108. The elastic member 604 is made of materials that indicate elasticity when formed in thin piece or flake. Exemplary materials include rubber, plastic, and metal.

Further, a recess may be formed to the inner wall 602*a* of the cartridge case 602 at a portion against which the pressing member 120 is to be pressed with the upper ink channel 108 therebetween, so that the upper ink channel 108 can be reliably closed by the pressing member 120. Furthermore, the side of the upper ink channel 108 facing the recess may be fixed to the inner wall of the recess. If the elastic member 604 is attached to the upper ink channel 108 at the side facing the recess, the elastic member 604 may be fixed to the inner wall of the recess. If the upper ink channel 108 provided with the elastic member 604 is arranged as above, the upper ink channel 108 restores to the open state by means of the elasticity of the elastic member 604 more reliably, and allows the ink to flow therethrough smoothly. It is also preferable that the recess is formed so as to allow the pressing member 120 fitting right therein. Further, the surface of the pressing head 24 may be made of an elastic member.

It should be noted that the ink passing through the upper ink channel 108 does not come into contact with the thin plate like elastic member 604 since the elastic member 604 is attached to the outer surface of the upper ink channel 108. Therefore, the elastic member 604 does not cause foreign matter or dust getting into the ink. Further, the elastic member 604 does not deteriorate the ink and vice versa.

FIGS. 8A through 8F illustrate the process of replenishing the lower ink bag 106 with the ink from the upper ink bags 104 according to an embodiment of the invention.

Figures 8A, 8B, 8C, 8D, 8E, 8F:
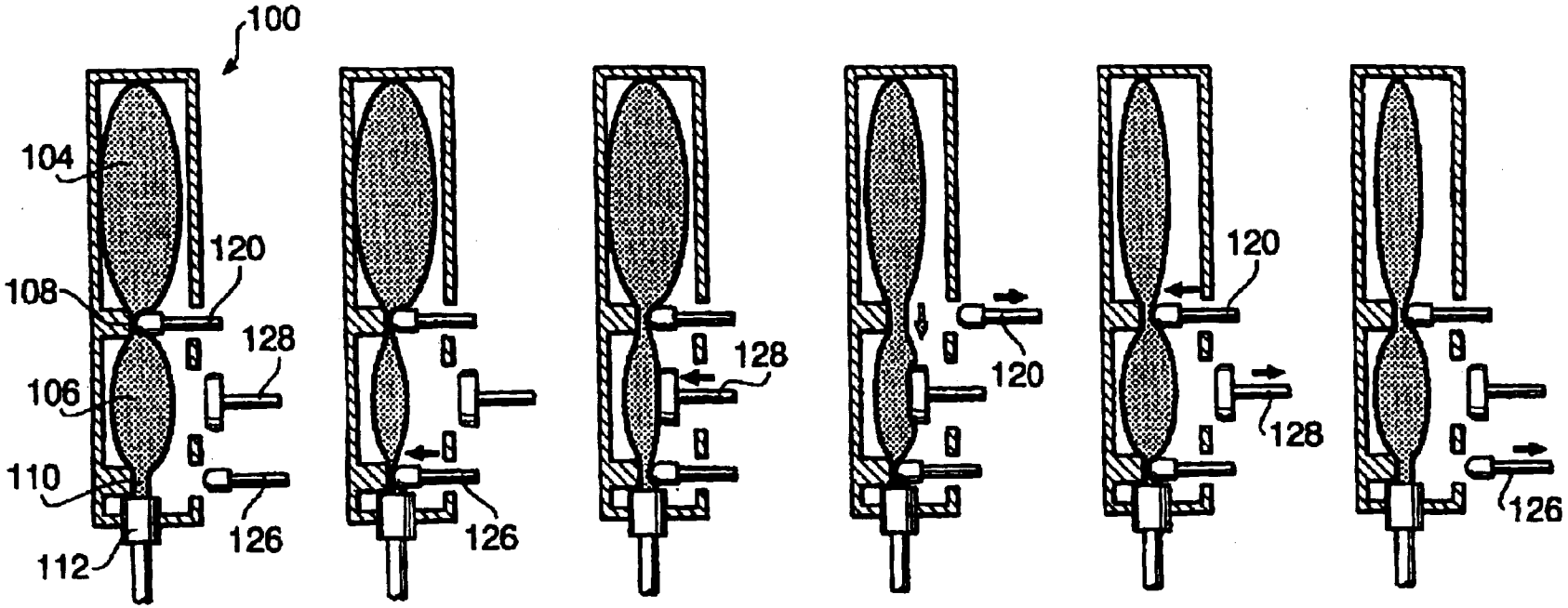
FIGS. 8A through 8F illustrate a process of replenishing within the ink cartridge according to an embodiment of the invention.
Figures 9A, 9B, 9C, 9D, 9E, 9F:
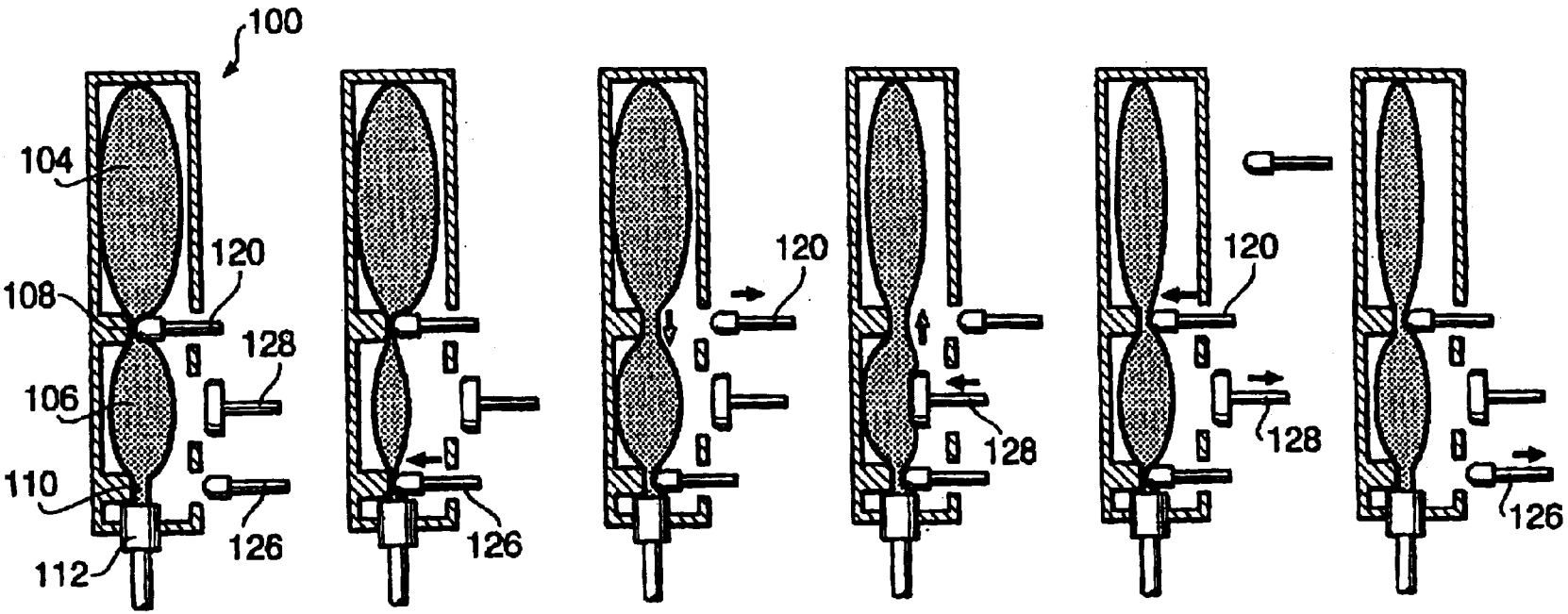
FIGS. 9A through 9F illustrate a modification of the process shown in FIGS. 8A through 8F.

As shown in FIG. 8A, during the printing operation of the ink-jet recording device to which the ink cartridge 100 according to the first embodiment of the invention is installed, the pressing member 120 presses the upper ink channel 108 and thereby closes the upper ink channel 108. Thus, the remaining amount of ink within the lower ink bag 106 gradually decreases, and when ink replenishment of the lower ink bag 106 is required, the lower ink channel 110 is closed by pressing it with another pressing member 126 provided to the ink-jet recording device (see FIG. 8B). The ink pressure within the lower ink bag 106 may change during the subsequent ink replenishment of the lower ink bag 106. The closed lower ink channel 110, however, prevents the pressure change to be transmitted to the printhead H and breaking the ink meniscus formed within the printhead H.

Then, a pressing plate 128 of the ink-jet recording device (not shown) is pressed against the side of the lower ink bag 106 to restrict the inflation of the lower ink bag 106 and thereby control the amount of ink supplied thereinto (see FIG. 8C). Thus, the amount of ink within the lower ink bag 106 will not exceed a predetermined value. In other words, the pressing plate 128 prevents the lower ink bag 106 from being fully filled.

Then, the pressing member 120 retracts to stop pressing the upper ink channel 108. Thus, the upper ink channel 108 opens and allows the ink flowing down from the upper ink bag 104 into the lower ink bag 106 (see FIG. 8D).

After the lower ink bag 106 is filled with a predetermined amount of ink, the pressing member 120 presses the upper ink channel 108 and thereby close the upper ink channel 108 again. Thereafter, the pressing plate 128 moves apart from the lower ink bag 106 (see FIG. 8E).

Next, the pressing member 126 retracts from lower ink channel 110. Thus, the lower ink channel 110 opens and allows the ink to be supplied from the lower ink bag 106 into the printhead H again (see FIG. 8F). It should be noted that the ink pressure change caused within the printhead H by the opening of the lower ink channel 110 is small and does not breaks the ink meniscus in the printhead H. Thus, the printing operation can be smoothly restarted. It should be also noted that the time required for the ink replenishment described above is short and does not vary with the amount of ink remaining in the upper ink bag 104. Therefore, the replenishment of the lower ink bag 106 does not slow down the overall printing rate of the ink-jet recording device.

FIGS. 9A through 9F illustrate a modification of the process shown in FIGS. 8A through 8F. The process shown in FIGS. 9A through 9F differs from the process shown in FIGS. 8A through 8F in that the pressing plate 128 is pressed against the side of the lower ink bag 106 (see FIG. 9D), in order to adjust the amount of ink supplied into the lower ink bag 106, after lower ink bag 106 is once filled with the ink by opening the upper ink channel 108 (see FIG. 3C). Except the above, the process shown in FIGS. 9A through 9F is substantially the same as that shown in FIGS. 8A through 8F.

Note that, when the ink of the upper and lower ink bags 104, 106 is consumed, the ink cartridge 100 in the ink-jet recording device is replaced with a new one.

While the invention has been described in connection with specific exemplary embodiments thereof, it should be understood that the invention is not limited to the above-described exemplary embodiment. For example, the upper ink channel 108 can be also made by folding one elastic sheet and fixing (by welding, for example) the side edges thereof to each other.

The present disclosure relates to the subject matter contained in Japanese Patent Application No. P2002-162422, filed on Jun. 4, 2002, which is expressly incorporated herein by reference in its entirety.

What is claimed is:

1. An ink cartridge for an ink-jet recording device including a closing mechanism that includes a pressing member, comprising:

first and second ink bags adapted to hold ink therein;

an ink channel formed between said first and second ink bags, said ink channel allowing said first ink bag to be supplied with the ink from said second ink bag; said ink channel being made of flexible material and capable of being opened and closed by the closing mechanism of the ink-jet recording device;

an ink flow enhancing mechanism that allows the ink to flow smoothly through said ink channel when said ink channel is not closed by the closing mechanism; and a cartridge case, said first and second ink bags and said ink channel being placed within said cartridge case, wherein the ink flow enhancing mechanism includes a recess that receives the ink channel, when the pressing member of the closing mechanism presses the ink channel against a portion of the cartridge case to close the ink channel.

2. The ink cartridge according to claim 1, comprising, more than two ink bags, each ink bag adapted to hold ink therein, said more than two ink bags being connected to each other to allow ink flowing thereamong, said plurality of ink bags including said first and second ink bags connected by said ink channel.

3. The ink cartridge according to claim 1, wherein the ink channel may be pressed, by the pressing member, perpendicularly to a flow direction of the ink flowing through the ink channel.

4. The ink cartridge according to claim 1, wherein said recess is formed to allow the pressing member to fit therein.

5. The ink cartridge according to claim 4, wherein said ink channel is made of first and second sheets fixed to each other along side edges thereof, said ink channel being placed within said cartridge case with said first sheet facing said recess, a portion of said first sheet extending over said recess having a longer width than said recess.

6. The ink cartridge according to claim 5, wherein said ink channel has first and second side edges, said first and second sheets being fixed to each other at said first and second side edges of said ink channel, and wherein said first sheet has a length between said first and second side edges of said ink channel 1% through 30% longer than a length of said second side edges.

7. The ink cartridge according to claim 5, wherein said ink channel has first and second side edges, said first and second sheets being fixed to each other at said first and second side edges of said ink channel, and wherein said first sheet has a length between said first and second side edges of said ink channel 1% through 30% longer than a distance between said first and second side edges.

8. The ink cartridge according to claim 4, wherein at least one of the pressing member and an inner wall of said recess is made of elastic material.

9. The ink cartridge according to claim 6, wherein a side of said ink channel opposing said recess is at least partially fixed to an inner wall of said recess.

10. The ink cartridge according to claim 1, wherein said second ink bag has a larger volumetric capacity than said first ink bag, said second ink bag having an inner wail formed to decline toward an inlet of said ink channel.

11. The ink cartridge according to claim 1, wherein said first ink bag has a horizontal dimension longer than a vertical dimension thereof.

12. The ink cartridge according to claim 1, wherein said first and second ink bags and said ink channel are formed in a single-piece.

13. The ink cartridge according to claim 1, further comprising a cartridge case, wherein said first and second ink bags and said ink channel are fixed to an inner wall of said cartridge case by welding.

14. An ink cartridge for an ink-jet printer, comprising:

first and second ink containers, said second ink container being disposed below a printhead of the ink-jet printer and connected to the printhead for supplying ink when said ink cartridge is installed in the ink-jet printer; and an ink channel connecting said first and second ink containers so as to allow ink held in said first ink container being supplied into said second ink container, said ink channel being formed of elastic first and second sheets fixed to each other along side edges thereof, said second sheet having elasticity and being biased to be spaced apart from said first sheet by the elasticity.

15. The ink cartridge according to claim 14, wherein said second sheet is formed to have a shorter width than said first sheet.

16. The ink cartridge according to claim 15, further comprising a wall provided with a recess, wherein said ink channel is disposed in front of said wall with said first sheet facing said recess, said first sheet has a bent shape protruding into said recess.

17. The ink cartridge according to claim 16, wherein said first sheet is at least partially fixed to said recess.

18. The ink cartridge according to claim 16, wherein said second sheet has a substantially flat shape.

19. The ink cartridge according to claim 16, wherein said second sheet has a bent shape protruding in a direction opposite to said recess.

20. The ink cartridge according to claim 16, wherein a space defined within said ink channel has substantially the same width as said recess.

21. The ink cartridge according to claim 16, wherein a space defined within said ink channel has a shorter width compared to said recess.

22. The ink cartridge according to claim 16, wherein an inner wall of said recess is made of elastic material.

23. The ink cartridge according to claim 14, wherein an elastic member is disposed between said first and second sheets, said elastic member biasing said second sheet to be spaced apart from said first sheet.

24. The ink cartridge according to claim 23, wherein said elastic member has a hollow cylindrical shape so as to allow the ink flowing therethrough.

25. The ink cartridge according to claim 14, wherein an elastic member is bonded on an outer surface of at least one of said first and second sheets, said elastic member biasing said sheet to be spaced apart from said first sheet.

26. The ink cartridge according to claim 25, wherein said elastic

* * * * *